US005787725A

United States Patent [19]

Shin

[11] Patent Number: 5,787,725

[45] Date of Patent: Aug. 4, 1998

[54] REFRIGERATOR AND METHOD FOR CIRCULATING COLD AIR THEREIN

[75] Inventor: Jun-Chul Shin, Incheon, Rep. of Korea

[73] Assignee: Daewoo Electronics, Ltd., Jung-Ku

[21] Appl. No.: 628,264

[22] Filed: Apr. 5, 1996

[30] Foreign Application Priority Data

Apr. 6, 1995 [KR] Rep. of Korea ..... 1995-7965

[51] Int. Cl.[6] ..... F25D 11/02; F25D 17/04; F25D 21/06

[52] U.S. Cl. ..... 62/443; 62/408; 62/276

[58] Field of Search ..... 62/404, 407, 408, 62/443, 441, 272, 275, 276

[56] References Cited

U.S. PATENT DOCUMENTS

| | | | |
|---|---|---|---|
| 3,015,215 | 1/1962 | Tobey | 62/408 |
| 3,050,956 | 8/1962 | Mann et al. | 62/408 |
| 3,093,981 | 6/1963 | O'Grady | 62/408 |
| 3,359,750 | 12/1967 | Hanson | 62/408 |
| 5,214,936 | 6/1993 | Lim et al. | 62/407 |
| 5,255,536 | 10/1993 | Jung et al. | 62/515 |
| 5,433,086 | 7/1995 | Cho et al. | 62/455 |
| 5,501,084 | 3/1996 | Chang et al. | 62/264 |

FOREIGN PATENT DOCUMENTS

| | | | |
|---|---|---|---|
| 248370 | 12/1987 | European Pat. Off. | 62/407 |

*Primary Examiner*—William Doerrler
*Attorney, Agent, or Firm*—Fish & Richardson

[57] ABSTRACT

A refrigerator and a method for circulating cold air in the refrigerator are provided for blocking the backward stream of cold air within a freezing chamber and a main cold air duct into a cold chamber regardless of occurrence of a pressure difference caused by different supply amount of the cold air to the freezing chamber and cold chamber, thereby preventing freezing of food within the cold chamber. For this, an evaporator produces the cold air supplied to the freezing chamber, and a fan apparatus draws in the cold air within the freezing chamber. Ducts allowing for the flow of the cold air includes the main cold air duct which leads the cold air admitted from the fan apparatus to return to the freezing chamber via the evaporator, a cooling duct branched from the main cold air duct to supply the cold air to the cold chamber and a cold air return duct for leading the cold air within the cold chamber to return to the evaporator.

4 Claims, 2 Drawing Sheets

REFRIGERATOR AND METHOD FOR CIRCULATING COLD AIR THEREIN

BACKGROUND OF THE INVENTION

1. Field of the Invention

The present invention relates to a refrigerator, and more particularly, to a refrigerator wherein a structure of a duct for supplying cold air required for freezing and cooling operation therein is changed, and a method for circulating the cold air in the refrigerator.

2. Description of the Prior Art

A refrigerator is generally divided into a freezing chamber and a cold chamber. FIG. 1 illustrates a sectional view of such a conventional refrigerator. As shown in FIG. 1, refrigerator 1 is partitioned into freezing chamber 2 in the upper end and cold chamber 3 in the lower end. Also, a plurality of cold air ducts which allow for the flow of the cold air, an evaporator 4 and the like are provided thereto.

A cooling fan 7 and a fan motor 6 for ejecting the cold air to the interior of freezing chamber 2 are installed to the upper portion of the rear side of freezing chamber 2. A cold air suction pipe 10 for drawing in the cold air within freezing chamber 10 is provided in the door area of the bottom plane of freezing chamber 2.

Cold air suction pipe 10 is branched into a cold air guide opening 9 heading toward cold chamber 3 and a first suction port 12 heading toward evaporator 4. First suction port 12 is connected to evaporator 4 of which one side is connected to a main cold air duct 5. Main cold air duct 5 is open at the upper end of freezing chamber 2 while including cooling fan 7 and fan motor 6.

Cold air guide opening 9 branched from cold air suction pipe 10 is connected to be communicated with the interior of cold chamber 3, and a flow path switching device 8 is installed to the outlet side of cold air guide opening 9. A second suction port 11 for drawing in the cold air of cold chamber 3 is formed at one side of the upper portion of cold chamber 3, which is connected to a portion of connecting first suction port 12 to evaporator 4.

The above-stated freezing chamber 2 and cold chamber 3 of refrigerator 1 are operated as below. Upon the generation of the cold air from evaporator 4 by the expansion of a refrigerant gas, the cold air is forcibly blown within main cold air duct 5 by means of cooling fan 7 rotated together with fan motor 6. The forcibly blown cold air is ejected to the interior of freezing chamber 2 via the outlet side of main cold air duct 5 to maintain the interior of freezing chamber 2 under a proper ambience.

The cold air within freezing chamber 2 is drawn in via cold air suction pipe 10, so that some of the cold air are directed toward evaporator 4 via first suction port 12 and some are sent to cold chamber 3 via cold air guide opening 9. At this time, the cold air having passed through first suction port 12 is mixed with that having passed through second suction port 11 to be admitted into evaporator 4, thereby executing the heat exchange.

In accordance with the above-described procedure, the freezing and cooling operation of conventional refrigerator 1 is accomplished.

In conventional refrigerator 1, however, cooling fan 7 is installed to the rear side of freezing chamber 2. For this reason, when cooling fan 7 is operated, the cold air is directly supplied to freezing chamber 2 but is indirectly supplied to cold chamber 3. Thus, the supply amount of the cold air to freezing chamber 2 and cold chamber 3 differs from each other to cause a pressure difference. Once the pressure difference appears, the cold air of freezing chamber 2 flows from first suction port 12 to second suction port 11 or streams backward in main cold air duct 5. Consequently, a temperature in cold chamber 3 is lowered down from a predetermined temperature, which results in problems such as freezing of food within cold chamber 3.

SUMMARY OF THE INVENTION

The present invention is devised to solve the foregoing problems. Therefore, it is an object of the present invention to provide a refrigerator having a cold air duct for preventing the backward flow of cold air of a freezing chamber and a main cold air duct and a method for circulating the cold air in the refrigerator.

To achieve the above object of the present invention, there is provided a refrigerator which includes an evaporator for generating cold air supplied to a freezing chamber, and a fan apparatus for drawing in the cold air within freezing chamber. The fan apparatus is connected to a main cold air duct of which one side is connected to the freezing chamber for leading the cold air admitted from the fan apparatus to return to the freezing chamber via the evaporator. A cooling duct branched from the main cold air duct supplies the cold air to a cold chamber, and a cold air return duct has one side connected to the cold chamber and another side connected to the main cold air duct for leading the cold air within the cold chamber to return to the evaporator.

Here, it is preferable that the evaporator is installed within the main cold air duct, and especially placed between the freezing chamber and cold chamber within the main cold air duct.

In addition, a defroster may be installed to the evaporator for removing frost created to the evaporator, which may be formed of an electric heater for producing heat, and an abutting plate for transmitting the heat produced from the electric heater to the evaporator.

Preferably, the fan apparatus is installed to the upper portion of the rear side of the freezing chamber, and the other side of the main cold air duct is installed to the door area of the bottom plane of the freezing chamber.

Also, a damper is further installed to one side of the cooling duct for adjusting the quantity of the cold air flowing toward the cold chamber.

At this time, one side of the cold air return duct is installed to the upper portion of the door area of the cold chamber, another side of the cold air return duct consists of the abutting plate, and the other side of the cold air return duct is connected to the main cold air duct heading toward the evaporator.

To settle the above object of the present invention, a refrigerator includes an evaporator for generating cold air supplied to a freezing chamber, a fan apparatus for drawing in the cold air within freezing chamber, a main cold air duct having one side connected to the fan apparatus and another side connected to the freezing chamber for leading the cold air admitted from the fan apparatus to return to the freezing chamber via the evaporator, a cooling duct branched from the main cold air duct for supplying the cold air to a cold chamber, and a cold air return duct having one side connected to the cold chamber and another side connected to the main cold air duct for leading the cold air within the cold chamber to return to the evaporator. In this construction, the evaporator which is placed between the freezing chamber and cold chamber within the main cold air duct is formed of an electric heater for producing heat and an abutting plate for transmitting the heat produced from the electric heater to the evaporator, the fan apparatus is installed to the upper portion of the rear side of the freezing chamber, the other side of the main cold air duct is installed to the door area of the bottom plane of the freezing chamber, and a damper is installed to one side of the cooling duct for adjusting the quantity of the cold air flowing toward the cold chamber. Also, one side of the cold air return duct is installed to the upper portion of the door area of the cold chamber, another side of the cold air return duct is formed of the abutting plate, and the other side of the cold air return duct is connected to the main cold air duct heading toward the evaporator.

To achieve the above object of the present invention, a method for circulating cold air in a refrigerator is carried out by the step of supplying the cold air produced from an evaporator to a freezing chamber, drawing in the cold air within the freezing chamber by means of a fan apparatus, and leading the cold air drawn in from the fan apparatus by means of a main cold air duct having one side connected to the fan apparatus and another side connected to the freezing chamber to return to the freezing chamber via the evaporator. Then, the cold air branched from the main cold air duct is supplied to a cold chamber, and the cold air within the cold air returns to the evaporator via the cold air return duct having one side connected to the cold chamber and the other side connected to the main cold air duct.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
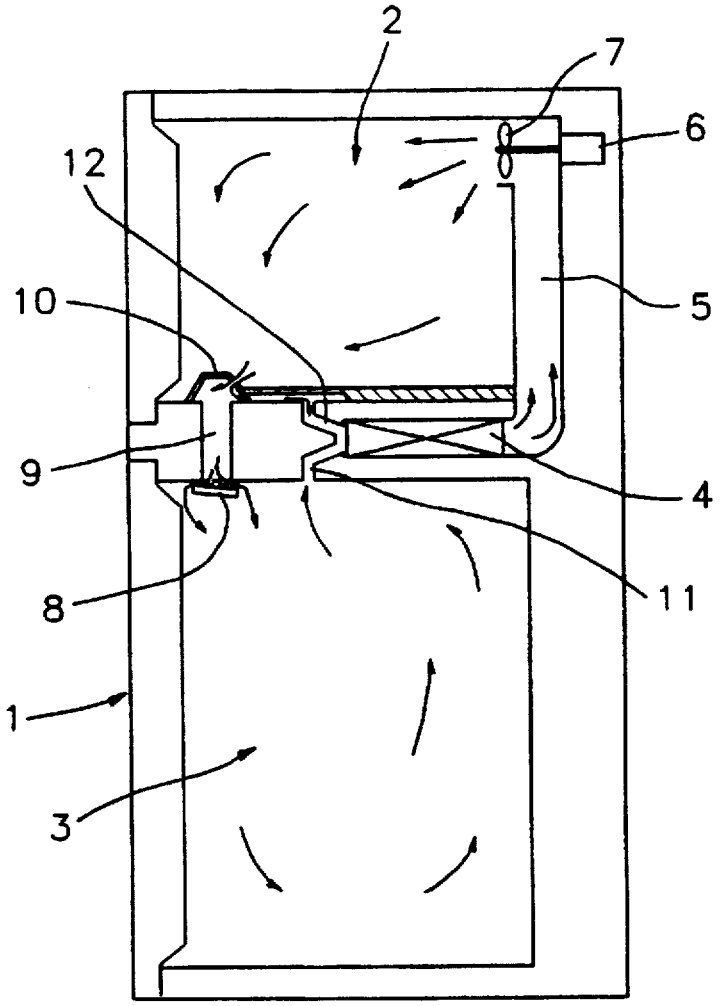
FIG. 1 PRIOR ART
FIG. 1 is a sectional view showing a conventional refrigerator.
Figure 2:
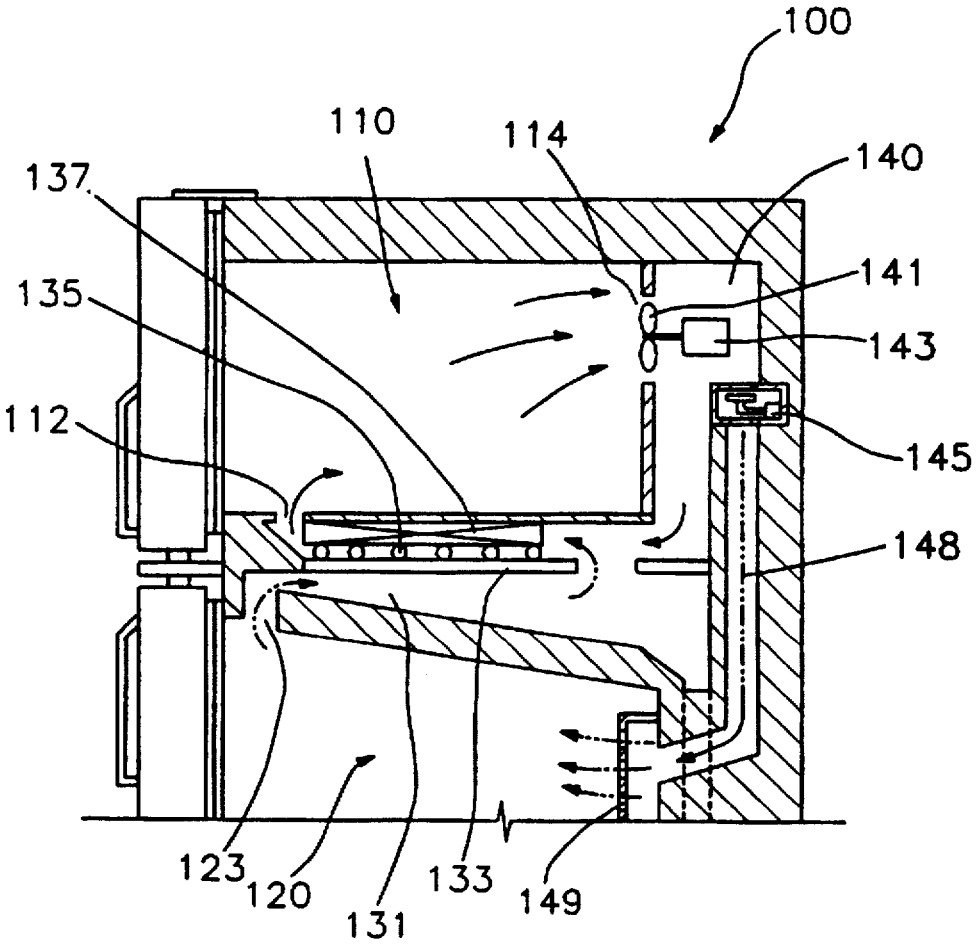
FIG. 2 is a sectional view showing a freezing chamber section in a refrigerator according to the present invention.

FIG. 2 illustrates a sectional view of a freezing chamber of a refrigerator according to the present invention.

Referring to FIG. 2, the interior of refrigerator 100 is divided into freezing chamber 110 and a cold chamber 120. A space called as a main cold air duct 140 is formed between freezing chamber 110 and cold chamber 120 and in the rear side of freezing chamber 110.

One side of main cold air duct 140 is open at the upper portion of the rear side of freezing chamber 110 while forming a cold air suction hole 114, and another side thereof is open at the door area of the bottom plane of freezing chamber 110 while constituting a cold air ejecting outlet 112. Cold air suction hole 114 is installed with a cooling fan 141 and a fan motor 143 for taking in the cold air within freezing chamber 110, and a cooling duct 148 connected to cold chamber 120 is branched in an area downwardly proceeding along main cold air duct 140.

One side of cooling duct 148 is connected to main cold air duct 140, and a damper 145 for adjusting the flow of the cold air is installed to their connecting portion. Damper 145 is internally furnished with a temperature sensing section (not shown) and a cold air switching device (not shown) to function by monitoring the temperature within cold chamber 120 and adjusting the quantity of the cold air flowing through cooling duct 148 in correspondence to the monitored temperature. The other side of cooling duct 148 is connected until reaching the rear side within cold chamber 120 to be connected to the interior of cold chamber 120 via cold air ejecting outlet 149.

A cold air suction port 123 for the use in cold chamber 120 for drawing in the cold air within cold chamber 120 is provided to the door area of the upper portion of cold chamber 120. Cold air suction port 123 for the use in cold chamber 120 constitutes one side of a cold air return duct 131 of which another side is connected to main cold air duct 140 via a hole formed in an abutting plate 133.

An evaporator 137 is installed within main cold air duct 140 which passes between freezing chamber 110 and cold chamber 120, and an electric heater 135 and abutting plate 133 are attached thereto for eliminating frost produced from evaporator 137. Electric heater 135 is installed to contact between evaporator 137 and abutting plate 133. One side of abutting plate 133 which is formed of a metal substance having a good heat transmission property contacts electric heater 135 and the opposite side forms one surface of cold air return duct 131.

Operation and effect of the refrigerator having the above-described construction will be described below.

The cold air within freezing chamber 110 passes through cold air suction hole 114 to be admitted to the interior of main cold air duct 140 in accordance with the rotation of cooling fan 141. The admitted cold air downwardly flows along main cold air duct 140 and is mixed with the cold air of cold chamber 120 at the point of encountering cold air return duct 131 prior to passing through evaporator 137. The cold air which exchanges the heat while passing through evaporator 137 is ejected to the interior of freezing chamber 110 again via cold air ejecting outlet 112.

When the temperature in cold chamber 120 exceeds a predetermined temperature, damper 145 is operated to lead some of the cold air downwardly proceeding within main cold air duct 140 to flow through cooling duct 148. The cold air downwardly proceeding within cooling duct 148 is ejected to the interior of cold chamber 120 via cold air ejecting outlet 149 for the use in cold chamber 120. The ejected cold air circulates through cold chamber 120, and is admitted into cold air return duct 131 via cold air suction port 123. The cold air admitted to the interior of cold air return duct 131 flows to the backward side of refrigerator 100 to pass through the hole formed in abutting plate 133, thereby being mixed with the cold air flowing through main cold air duct 140.

If the temperature within cold chamber 120 is below the predetermined temperature, damper 145 closes one side of cooling duct 148 to block the flow of the cold air toward cold chamber 120. In this case, the cold air is not supplied to cold chamber 120 but is ejected to the interior of freezing chamber 110 via evaporator 137 directly from main cold air duct 140. That is, the cold air circulates only through freezing chamber 110.

Also, the cold air returning from cold chamber 120 to evaporator 137 is relatively high in temperature and humidity. Thus, if evaporator 137 is frosted, electric heater 135 is operated to generate the heat required for defrosting. The generated heat is supplied to evaporator 137 directly or via abutting plate 133 to melt the frost.

As a result, even though the pressure differs due to the different amount of the cold air supplied into freezing chamber 110 and cold chamber 120, the backward flow of the cold air of freezing chamber 110 and main cold air duct 140 is blocked to prevent freezing of the food within cold chamber 120.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A refrigerator comprising:

an evaporator for generating cold air to be supplied to a freezing chamber;

a fan apparatus for drawing in said cold air within said freezing chamber;

a main cold air duct having one side connected to said fan apparatus and another side connected to said freezing chamber for leading said cold air admitted from said fan apparatus to return to said freezing chamber via said evaporator, said evaporator being installed within said main cold air duct;

defroster means installed to said evaporator for removing frost formed in said evaporator, said defroster means having an electric heater for producing heat and an abutting plate for transmitting said heat produced from said electric heater to said evaporator;

a cooling duct branched from said main cold air duct for supplying said cold air to a cold chamber;

a cold air return duct having one side connected to an upper portion of a door area of said cold chamber and another side connected to a lower portion of said main cold air duct for leading said cold air within said cold chamber to return to said evaporator through a cold air suction port formed in said abutting plate; and a damper installed to one side of said cooling duct for adjusting a quantity of cold air flowing toward said cold chamber according to a temperature in said cold chamber, wherein said evaporator is placed between said freezing chamber and said cold chamber within said main cold air duct, and one side of said cold air return duct is comprised of said abutting plate.

2. A refrigerator as claimed in claim 1, wherein said fan apparatus is installed to the upper portion of the rear side of said freezing chamber.

3. A refrigerator as claimed in claim 1, wherein another side of said main cold air duct is installed to the door area of the bottom plane of said freezing chamber.

4. A refrigerator as claimed in claim 1, wherein said cold air return duct is connected to said main cold air duct heading toward said evaporator.

* * * * *